US008220625B2

(12) United States Patent
Michaels et al.

(10) Patent No.: US 8,220,625 B2
(45) Date of Patent: Jul. 17, 2012

(54) CONTAINER FOR CARRYING DIAPER CHANGING ITEMS

(76) Inventors: Dannielle Lisa Michaels, Windsor (AU); Monique Miriam Filer, Bondi Junction (AU)

( * ) Notice: Subject to any disclaimer, the term of this patent is extended or adjusted under 35 U.S.C. 154(b) by 44 days.

(21) Appl. No.: 12/742,895

(22) PCT Filed: Nov. 14, 2008

(86) PCT No.: PCT/AU2008/001692

§ 371 (c)(1),
(2), (4) Date: Aug. 19, 2010

(87) PCT Pub. No.: WO2009/062251

PCT Pub. Date: May 22, 2009

(65) Prior Publication Data

US 2011/0017745 A1 Jan. 27, 2011

(30) Foreign Application Priority Data

Nov. 14, 2007 (AU) ..... 2007906218

(51) Int. Cl.
*B65D 71/00* (2006.01)

(52) U.S. Cl. ..... 206/233; 206/581; 220/524; 220/523

(58) Field of Classification Search ..... 206/229, 206/233, 494, 812, 581; 220/521, 523, 524, 220/525, 526, 254.6, 254.3, 254.2, 254.1, 220/826, 810, 531, 529
See application file for complete search history.

(56) References Cited

U.S. PATENT DOCUMENTS

| | | | | |
|---|---|---|---|---|
| 1,495,046 | A | 5/1924 | Spiegel | |
| 1,513,860 | A | 11/1924 | Reutter | |
| 4,892,188 | A * | 1/1990 | Meadows | 206/223 |
| 4,936,463 | A * | 6/1990 | Tiramani | 206/581 |
| 5,638,957 | A * | 6/1997 | Brasier | 206/581 |
| 6,164,442 | A * | 12/2000 | Stravitz | 206/233 |
| 6,170,651 | B1 * | 1/2001 | Taormina | 206/5 |
| 7,201,271 | B1 * | 4/2007 | Saad | 206/63.5 |
| 7,665,625 | B1 * | 2/2010 | Rothstein et al. | 220/326 |
| 7,815,070 | B2 * | 10/2010 | Shoemaker | 221/45 |
| 8,016,155 | B2 * | 9/2011 | Decker et al. | 221/62 |
| 2002/0162842 | A1 * | 11/2002 | Pangerc et al. | 220/524 |
| 2003/0159403 | A1 * | 8/2003 | Verespej et al. | 53/412 |
| 2005/0115855 | A1 * | 6/2005 | Hilel et al. | 206/440 |
| 2006/0054517 | A1 * | 3/2006 | Albert | 206/233 |
| 2007/0199841 | A1 * | 8/2007 | Mesalic | 206/233 |

FOREIGN PATENT DOCUMENTS

WO 2003/051747 6/2003

OTHER PUBLICATIONS

International Search Report dated Feb. 25, 2009, issued in PCT/AU2008/001692.

* cited by examiner

*Primary Examiner* — David Fidei
(74) *Attorney, Agent, or Firm* — Polsinelli Shughart PC

(57) ABSTRACT

The present invention provides a container (10) for carrying one or more baby changing items comprising a base (15) having a first compartment (11) for storing one or more baby changing items, and a lid (20) pivotally connected to the base (15). The lid (20) comprises a second compartment (21) sealable from the first compartment (11) of the base (15) for storing one or more moist wipes (not illustrated) and an aperture (24) to allow access to the one or more moist wipes when the lid (20) is in a closed position.

15 Claims, 5 Drawing Sheets

CONTAINER FOR CARRYING DIAPER CHANGING ITEMS

FIELD OF THE INVENTION

This invention relates to containers for carrying items necessary for changing a baby's diaper. In particular, but not exclusively, the present invention relates to a compact portable container which provides multiple compartments for storing items such as diapers and wipes. It will be appreciated that the present invention has broader application and is not to limited to this particular use.

BACKGROUND OF THE INVENTION

Infants require their diaper to be changed several times a day in order to keep them clean, dry and comfortable. When changing a diaper, it is generally not only a clean diaper that is required, but other items such as wipes, cream, powder, disposable bags, changemats or the like.

The most common devices for carrying these items are diaper bags and foldable changing systems comprising multiple different compartments and can be quite cumbersome to carry around with a baby, particularly when only a couple of diapers may be needed. These can become quite bulky when full and can easily become soiled or damaged, particularly when made of a fabric material.

Various attempts have been made to alleviate these problems by providing portable hard case containers for carrying baby diaper changing items in a more compact manner. For example, U.S. Pat. No. 5,638,957 discloses a diaper and wipes carrying case comprising a base, a lid pivotally connected to the base and an internal partition for keeping the diapers separate from the wipes within the case.

U.S. Pat. No. 6,540,084 discloses a portable pack comprising a base for storing diapers, a lid pivotally connected to the base and a compartment received within the base of the pack, the compartment having a secondary base and lid for storing wipes therein.

U.S. Pat. No. 6,164,442 discloses a multi-compartment portable case for carrying personal items. In one embodiment, the case comprises a base and a lid, wherein the lid has a secondary internal lid having an aperture to allow access to items when the case is in an open position.

The disadvantage with the prior art is that it is necessary to open the container to access wipes stored within the container. Therefore, quick access cannot be achieved and a user can contaminate the container and the contents of the container before they are able to clean their hands. The box-like cases of the prior art are also quite bulky in size for handling and transportation.

OBJECTS OF THE INVENTION

It is a preferred object of the invention to provide a container for carrying one or more baby diaper changing items that addresses or ameliorates one or more of the aforementioned problems or provides a commercial alternative.

It is a further preferred object of the invention to provide a container for carrying one or more diaper changing items comprising a lid having an aperture which allows access to one or more wipes when the lid is in a closed position.

SUMMARY OF THE INVENTION

According to one aspect, the present invention resides in a container for carrying one or more baby changing items comprising:

a base having a first compartment for storing one or more baby changing items; and a lid pivotally connected to the base, the lid having a second compartment sealable from the first compartment of the base for storing one or more moist wipes, wherein the lid comprises an aperture to allow access to the one or more moist wipes when the lid is in a closed position.

Preferably, the lid comprises a secondary lid pivotally connected to the lid for providing a closure for the aperture.

Suitably, the secondary lid comprises a connection member for pivotally connecting the secondary lid to the lid.

Preferably, the secondary lid is received within a recessed portion surrounding the aperture of the lid.

Preferably, the secondary lid comprises a rib on an underside of the secondary lid for providing a seal for the aperture on the lid.

Preferably, the container further comprises an internal lid pivotally connected to the lid for sealing the second compartment from the first compartment of the base.

Suitably, the internal lid enables refilling of the second compartment.

Preferably, the internal lid comprises an aperture to allow access to the one or more moist wipes when the lid is in an open position.

Suitably, the internal lid has a secondary internal lid pivotally connected to the internal lid for providing a closure for the aperture in the internal lid.

Preferably, the secondary internal lid comprises a connection member for pivotally connecting the secondary internal lid to the internal lid.

Preferably, the secondary internal lid is received within a recessed portion surrounding the aperture of the internal lid.

Preferably, the secondary internal lid comprises a rib on an underside of the secondary internal lid for providing a seal for the aperture on the internal lid.

Preferably, the lid is pivotally connected to the base by a live hinge integrally formed with respective rear edges of the lid and the base.

Preferably, the container comprises a locking mechanism having a first resilient clip for securing the internal lid to the lid.

Suitably, the locking mechanism comprises a second resilient clip for securing the lid to the base.

Suitably, the base comprises at least one support foot.

Preferably, the base comprises a flexible arm for holding one or more baby diaper changing items.

Further aspects and features of the present invention will become apparent from the following detailed description.

BRIEF DESCRIPTION OF THE DRAWINGS

The invention will now be described in more detail, by way of examples, with reference to the accompanying drawings, wherein.

DETAILED DESCRIPTION OF THE PREFERRED EMBODIMENTS

Figure 1:
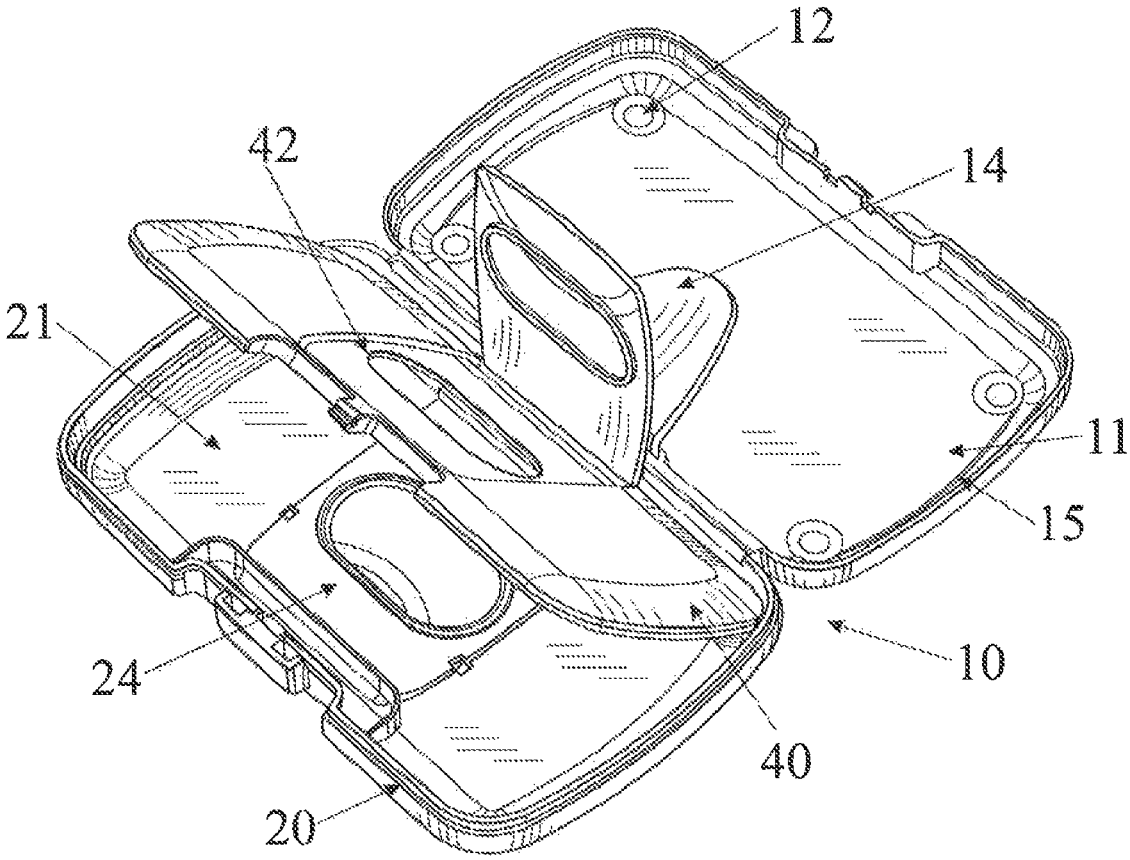
FIG. 1 is a perspective view showing the inside of a container a lid and an internal lid is in an open position.

Preferred embodiments of the container of the present invention are shown in the Figures and generally designated by the reference numeral 10. In FIG. 1, a container 10 of the present invention for carrying one or more baby diaper changing items is illustrated which comprises a lid 20 having a second compartment 21 for storing one or more wipes (not illustrated) and an aperture 24 to allow access to one or more moist wipes when the lid 20 is in a closed position.

The container 10 further comprises an internal lid 40 pivotally connected to an underside of the lid 20 which provides an internal closure for the second compartment 21. The internal lid 40 comprises an aperture 42 to allow access to one or more wipes when the lid 20 is in an open position. It will be understood that the layout of the container 10 could be altered as required to better suit the storage of different items.

The container 10, as best illustrated in FIG. 1, has a base 15 and the lid 20 pivotally connected to the base 15 for carrying at least one baby diaper changing item. The term 'diaper' is to be understood throughout the specification as referring to any suitable product for holding a baby's excrement and urine until disposed and may also be commonly referred to as nappy. Each of the components of the container 10 can be fabricated from a is plastic material, such as polypropylene, or any other suitable material which is preferably lightweight, water-resistant and easy to clean.

The dimensions of the container 10 are sufficient for carrying most standard sized diapers, wipes and other accessories, which are commonly used when changing a baby, but is not overly large to make the construction of the container 10 too bulky. While the shape of the container 10 may be varied as desired, it is preferred that the outer edges of the container 10 will be rounded to reduce the risk of accidental injury to a user or baby during use.

The base 15 comprises a first compartment 11 for storing one or more baby diaper changing items (not illustrated) which may include, but not be limited to, diapers, changemats, cream, powder or other suitable items commonly required when changing a baby's diaper which can be packaged to fit within the first compartment 11 and be carried in a compact manner. The base 15 comprises a flexible arm 14 for holding one or more baby diaper changing items within the first compartment 11.

Preferably, the base 15 is substantially flat so that it can be supported on a suitable surface to enable single-handed use by a user while changing a baby. Support and stability can further be provided by way of at least one support foot 12 protruding from a bottom surface of the base 15. As illustrated in FIG. 1, the base 15 has four support feet 12 which are made of a plastic moulded material and are integrally formed on each corner of the base 15. In alternative embodiments, the support feet 12 may be removable or provided in another suitable form. Further, the support feet 12 may be omitted from alternative embodiments if desired.

Figure 2:
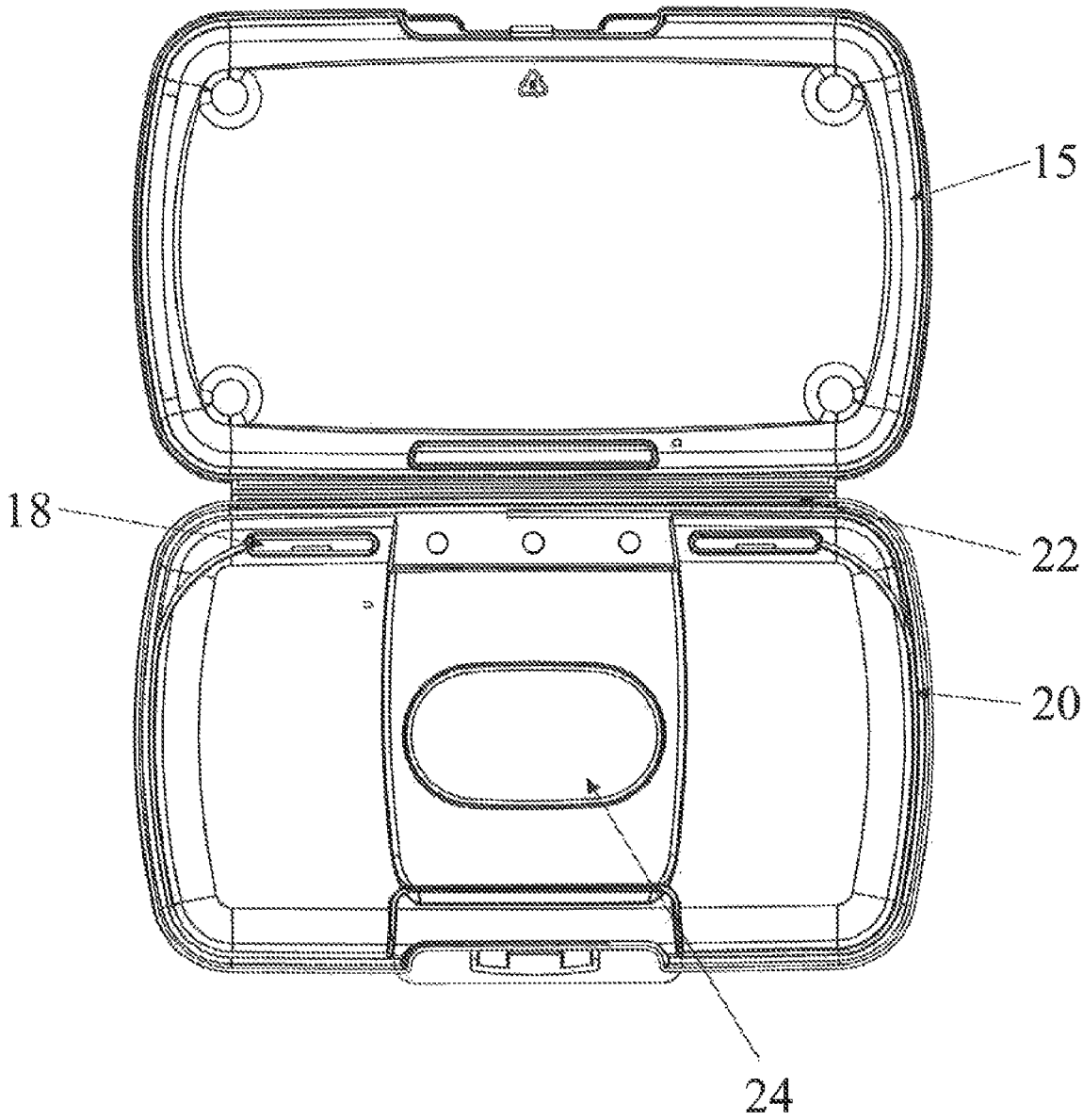
FIG. 2 is a plan view showing the outside of a container of FIG. 1 when the lid is in an open position.

With reference to FIG. 2, the lid 20 is pivotally connected to the base 15. The pivotal connection is provided on a respective rear edge of the lid 20 and the base 15 so that a front side of the lid 20 and the base 15 will remain separable for moving the lid 20 and base 15 apart to form an opening for the container 10. It will be understood that the relative position of the pivotal connection could be reversed or altered. For example, the pivotal connection could be positioned on a side of the base 15 and a side of the lid 20. The lid comprises at least one slot 18 for enabling the internal lid 40 to be connected to the lid 20.

The pivotal connection between the lid 20 and the base 15 is by way of a hinge assembly 22. In this embodiment, the hinge assembly 22 is in the form of a live hinge integrally formed with the respective rear edges of the base 15 and the lid 20 during the moulding process, to allow the lid to pivot with respect to the base and move through 180° from a closed position to a fully opened position. Preferably, the surfaces which form the live hinge are highly polished. Alternatively, two or more hinge assemblies 22 could be used. It is to be appreciated that the pivotal connection of the lid 20 to the base 15 could adopt one or more configurations different to that specifically described above. The pivotal connection could instead, for example, include an integral aperture on the base 15 for receiving a rod connected to the edge of the lid 20, or other pivotal or rotatable linkage arrangement.

Figure 3:
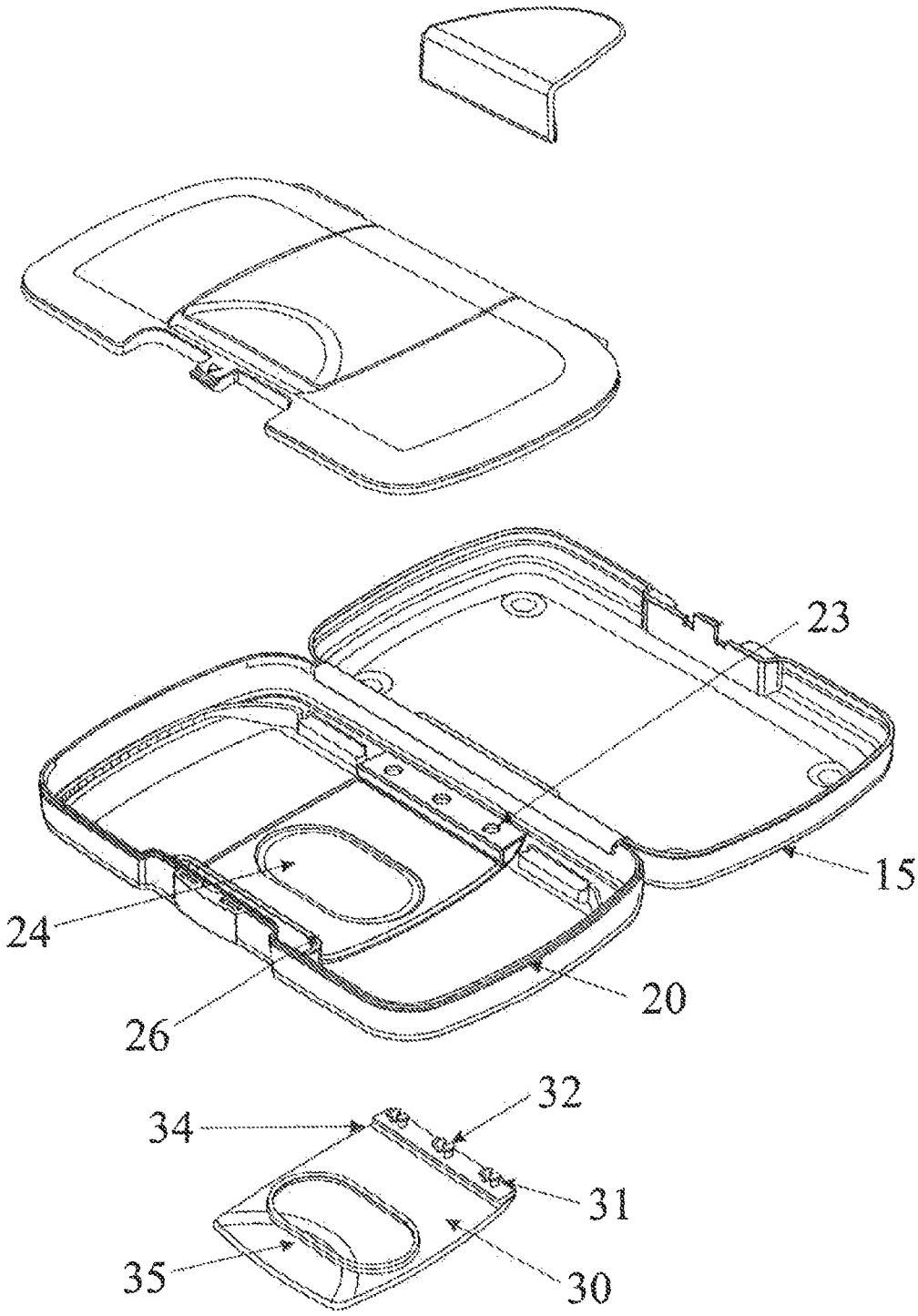
FIG. 3 is an exploded view of the container of FIG. 1 showing the positioning of an internal lid, a secondary lid and a flexible arm relative to the lid and a base of the container.

The lid 20 has an aperture 24 to allow access to one or more wipes when the lid 20 is in a closed position. Preferably, the aperture 24 is positioned substantially centrally on the surface of the lid 20. As shown in FIG. 3, a middle portion 26 of the surface of the lid 20 surrounding the aperture 24 is preferably recessed so that a secondary lid 30 can be received thereover in order to provide a seal for the aperture 24 to keep the wipes moist and prevent leakage or contamination until ready for use.

Preferably, the secondary lid 30 is pivotally connected to the back edge of the upper surface of the lid 20. The secondary lid 30 has a connection member 31 for securing the secondary lid 30 to the upper surface of the lid 20 and providing a pivot point for the secondary lid 30 to be rotated from a closed position lying against the lid's 20 surface, to an open position away from the lid's surface to expose the aperture 24. The connection member 31 comprises at least one clip 32. The clip 32 is preferably resilient and designed so that when it is received within a corresponding aperture 23 provided on the lid 20, it will expand and lock into place within the aperture 23. Alternatively, any other suitable fastening mechanism may also be used. A live hinge 34 integrally formed between the connection member 31 and the secondary lid 30 provides a pivot point for the secondary lid 30.

Preferably, a snap-locking mechanism (not illustrated) releasably secures the secondary lid 30 over the top of the aperture 24 to provide a closure for the aperture 24. Preferably, a rib 35 is provided on an underside of the secondary lid 30 having a complimentary shape to the aperture 24 so that the rib 35 can fit snugly within the aperture 24 to provide an air-tight seal around the aperture 24.

Figure 4:
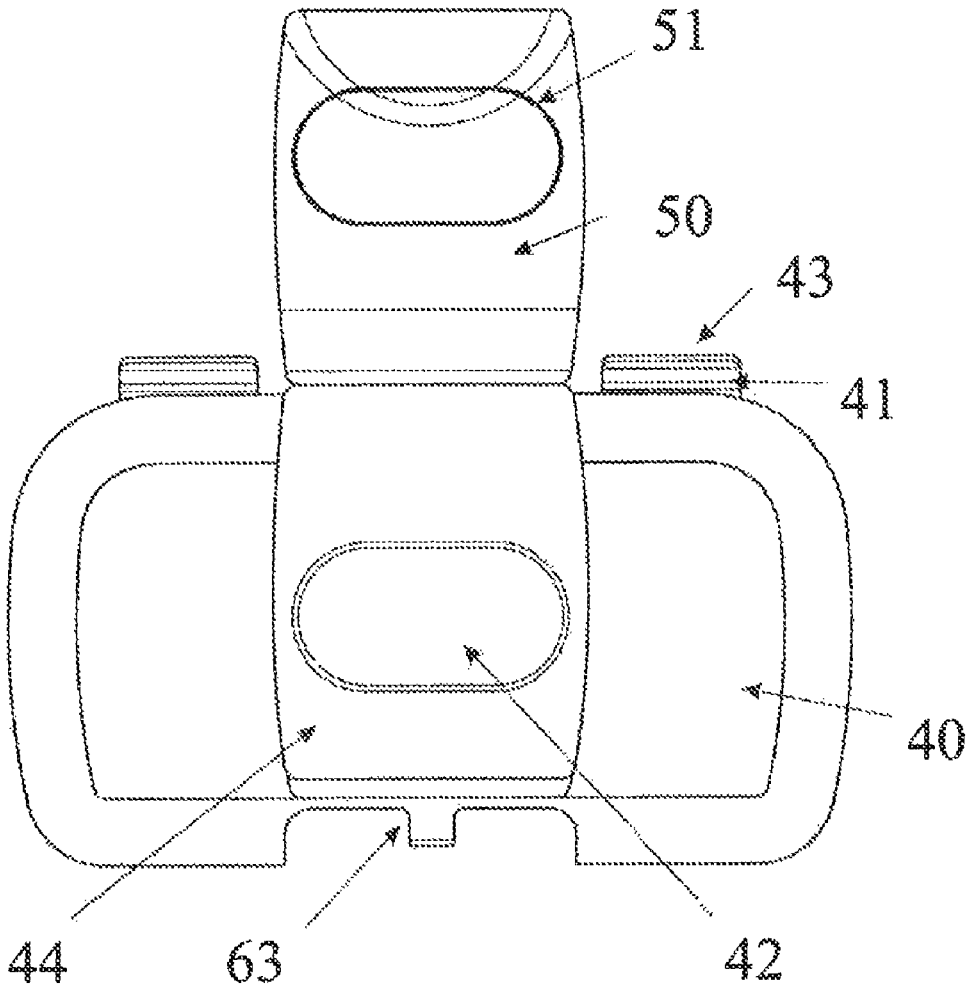
FIG. 4 is a plan view of the internal lid of the container of FIG. 1 showing a secondary internal lid in an open position.

Reference is now made to FIG. 4, which illustrates the internal lid 40. The internal lid 40 comprises at least one connection member 41 to provide a pivotal connection for the internal lid 40. The internal lid 40 comprises the aperture 42 which is positioned substantially centrally on the surface of the internal lid 40. As shown in FIG. 4, a middle portion 44 of the upper surface of the internal lid 40 surrounding the aperture 42 is recessed so that a secondary internal lid 50 can be received thereover to provide a closure for the aperture 42. The internal lid 40 comprises a protrusion 63 on a front edge of the internal lid 40 to be received within an aperture 62 of a locking mechanism 60, for securing the internal lid 40 to the lid 20.

According to some embodiments, a connection member 41 is positioned on either side of a rear edge of the internal lid 40. The connection member 41 comprises a protrusion 43 which is adapted to be received within the slot 18 provided on the lid 20 for securing the internal lid 40 to the lid 20. The connection member 41 comprises a live hinge (not illustrated) which provides the pivot point for the internal lid 40 and enables the internal lid 40 to pivot relative to the lid 20 to move from a closed position in connection with the lid 20 to an open position away from the lid 20, as shown in FIG. 1.

Preferably, the secondary internal lid 50 is pivotally connected to the rear edge the internal lid 40. The secondary internal lid 50 has a connection member (not illustrated) for securing the secondary internal lid 50 to the to internal lid 40 and providing a pivot point for enabling the secondary internal lid 50 to be lifted from a closed position lying against the secondary internal lid's 50 surface, to an open position away from the secondary internal lid's 50 surface to expose the aperture 42. Preferably, the connection means has a replica configuration to the connection member 31 for the secondary lid 30 illustrated in FIG. 3. Alternatively, any other suitable fastening mechanism may also be used.

Preferably, a snap-locking mechanism (not illustrated) releasably secures the secondary internal lid 50 over the top of the aperture 42 to provide a closure for the aperture 42. Preferably, a rib 51 is provided on an underside of the secondary internal lid 50 having a complimentary shape to the aperture 42 so that the rib 51 can fit snugly within the aperture 42 to provide an air-tight seal for the aperture 42. In an alternative embodiment of the invention, it is envisaged that the secondary internal lid 50 and the secondary lid 30 may be opened by way of a pop-up mechanism which will open the respective secondary internal lid 50 and secondary lid 30 when they are depressed.

Figure 5:
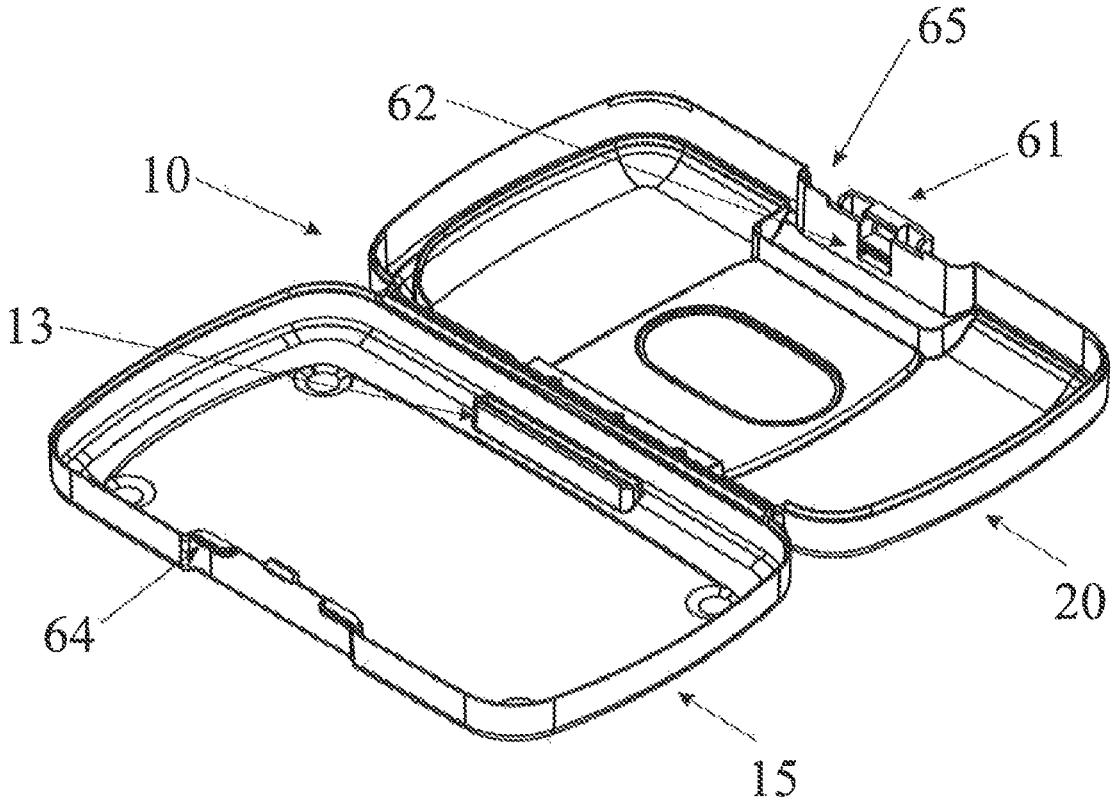
FIG. 5 is a perspective view showing the inside of the container of FIG. 1 when the lid is in an open position.

The lids 20, 40 can be secured in a closed position when not in use, or during transit, via a locking mechanism designed to be operated so that the user is able to keep one hand on the infant at all times. According to some embodiments, the locking mechanism comprises at least one resilient clip arrangement or other suitable means. The lid 20, as best illustrated in FIG. 5, has a first resilient clip 61 for securing the internal lid 40 to the lid 20. The first resilient clip 61 overlies an aperture 62 for receiving the protrusion 63 on the internal lid 40 for securing the internal lid 40 to the lid 20. The base 15 is provided with at least one resilient clip 64 having a hook portion for engaging with a corresponding recess 65 provided on the lid 20 to achieve a flush seal between the lid 20 and the base 15. The front edge of the container 10 surrounding the locking mechanism may preferably be recessed to provide easier access and assist a user in opening or closing the container 10.

The base 15 has a connection member 13 for receiving and being releasably engagable with a flexible arm member 14, as shown in FIG. 1. The connection member 13 is in the form of a flange integrally formed with a rear wall of the base 15. Alternatively, another suitable form of attachment may be used. Preferably, the arm member 14 is made of a rubber material that is adapted to gently fold back to enable a user to access one or more baby diaper changing items stored within the bottom storage compartment 11 and hold the items in place to ensure they will not fall out when the container 10 is opened. According to some embodiments where a changemat is provided, the changemat may be made of PVC and nylon or other suitable materials which is easy to clean and able to be folded into a thin unit to fit within the first compartment 11.

Preferably, a surface of the flexible arm 14 is substantially flat with dimensions suitable for allowing items to be held beneath the flexible arm 14. Provided along a rear edge of the flexible arm 14 is a flange (not illustrated) which extends perpendicularly from the surface of the flexible arm 14 so that it can be received within a groove (not illustrated) of the flange 13 to locking mechanism the flexible arm 14 in place. The inner surface of the base 15 may have provided at least one ridge or divider (not illustrated) or the like for dividing the storage area within the first compartment 11.

In practice, the user lifts the secondary lid 30 for quick and convenient access to one or more wipes before opening the container 10 and contacting the contents. The lid 20 can then be opened to expose the baby diaper changing items by pulling back the resilient clips 64 of the locking mechanism by applying sufficient force. The user can then readily access the one or more baby diaper changing items within the first compartment 11. While the lid 20 is in an open position, the secondary internal lid 50 can be opened to provide access to the wipes. Once finished, the reusable items can be neatly packed away until further use is required. In order to refill the second compartment with additional wipes, the resilient clip 61 can be pulled back to allow the protrusion 63 to be removed from the aperture 62 to release the internal lid 40 and allow access to the second compartment 21.

In a second aspect of the invention, not illustrated herein, it is envisaged that the container may have provided an elasticised strap member. The strap member is preferably adapted to be retractable and able to allow a user to store an additional nappy attached to the outer surface of the container. It is envisaged that further compartments may be provided for storing other items such as disposable bags, coins, a key or any other suitable items. A wrist strap member may also be provided for enabling the container to be carried on a person's wrist.

Although preferred embodiments of the invention have been described in detail and illustrated in the accompanying drawings, it is to be understood that the invention is not limited to these precise embodiments and that various changes and modifications may be effected therein without departing from the scope of the present invention.

We claim:

1. A container for carrying one or more baby changing items comprising:

a base having a first compartment for storing one or more baby changing items;

a lid pivotally connected to the base, the lid having a second compartment sealable from the first compartment of the base for storing one or more moist wipes, wherein the lid comprises an aperture to allow access to the one or more moist wipes when the lid is in a closed position;

an internal lid pivotally connected to the lid for sealing the second compartment from the first compartment of the base: and a secondary internal lid pivotally connected to the internal lid for providing closure for an aperture in the internal lid.

2. The container of claim 1 wherein the lid comprises a secondary lid pivotally connected to the lid for providing a closure for the aperture.

3. The container of claim 2 wherein the secondary lid comprises a connection member for pivotally connecting the secondary lid to the lid.

4. The container of claim 2 wherein the secondary lid is received within a recessed portion surrounding the aperture of the lid.

5. The container of claim 2 wherein the secondary lid comprises a rib on an underside of the secondary lid for providing a seal for the aperture on the lid.

6. The container of claim 1 wherein the internal lid enables refilling of the second compartment.

7. The container of claim 1 wherein the internal lid comprises an aperture to allow access to the one or more moist wipes when the lid is in an open position.

8. The container of claim 1 wherein the secondary internal lid comprises a connection member for pivotally connecting the secondary internal lid to the internal lid.

9. The container of claim 1 wherein the secondary internal lid is received within a recessed portion surrounding the aperture of the internal lid.

10. The container of claim 1 wherein the secondary internal lid comprises a rib on an underside of the secondary internal lid for providing a seal for the aperture on the internal lid.

11. The container of claim 1 wherein the lid is pivotally connected to the base by a live hinge integrally formed with respective rear edges of the lid and the base.

12. The container of claim 1 wherein the container comprises a locking mechanism having a first resilient clip for securing an internal lid to the lid.

13. The container of claim 12 wherein the locking mechanism comprises a second resilient clip for securing the lid to the base.

14. The container of claim 1 wherein the base comprises at least one support foot.

15. The container of claim 1 wherein the base comprises a flexible arm for holding one or more baby diaper changing items.

* * * * *